US008202071B2

(12) United States Patent
Kii et al.

(10) Patent No.: US 8,202,071 B2
(45) Date of Patent: Jun. 19, 2012

(54) MOTOR-DRIVEN SCROLL TYPE COMPRESSOR

(75) Inventors: Norimichi Kii, Aichi-ken (JP); Ken Suitou, Aichi-ken (JP); Tatsuya Ito, Aichi-ken (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 416 days.

(21) Appl. No.: 12/477,967

(22) Filed: Jun. 4, 2009

(65) Prior Publication Data

US 2009/0304539 A1 Dec. 10, 2009

(30) Foreign Application Priority Data

Jun. 5, 2008 (JP) ..... 2008-148168
Nov. 4, 2008 (JP) ..... 2008-283577

(51) Int. Cl.
*F03C 4/00* (2006.01)
*F04C 15/00* (2006.01)
*F04C 2/00* (2006.01)

(52) U.S. Cl. ..... 418/94; 418/55.6; 418/102; 418/270; 418/DIG. 1; 184/6.17

(58) Field of Classification Search ..... 418/94, 418/102, 270, DIG. 1, 55.1–55.6, 57; 184/6.16–6.18
See application file for complete search history.

(56) References Cited

U.S. PATENT DOCUMENTS

| | | | | |
|---|---|---|---|---|
| 4,538,975 | A * | 9/1985 | Tsukagoshi | 418/55.6 |
| 4,596,521 | A * | 6/1986 | Murayama et al. | 418/55.1 |
| 4,889,471 | A * | 12/1989 | Izunaga et al. | 418/94 |
| RE33,236 | E * | 6/1990 | Hazaki et al. | 418/94 |
| 6,672,101 | B2 * | 1/2004 | Gennami et al. | 418/55.6 |
| 7,101,160 | B2 * | 9/2006 | Gennami et al. | 418/55.6 |
| 7,140,852 | B2 * | 11/2006 | Koide et al. | 418/55.5 |
| 7,264,453 | B2 * | 9/2007 | Gennami et al. | 418/55.6 |

FOREIGN PATENT DOCUMENTS

| | | |
|---|---|---|
| JP | 03-047488 A | 2/1991 |
| JP | 2004-316537 A | 11/2004 |
| JP | 2007-321588 A | 12/2007 |

* cited by examiner

*Primary Examiner* — Theresa Trieu
(74) *Attorney, Agent, or Firm* — Sughrue Mion, PLLC

(57) ABSTRACT

In a motor-driven scroll type compressor, a rotary shaft includes a first opening at a position adjacent to a front end of the rotary shaft and facing an inner surface of a bearing for rotatably supporting the front end of the rotary shaft, a second opening at a position adjacent to a rear end of the rotary shaft and communicating with a back pressure chamber provided in front of a movable scroll member in a housing of the compressor, a communication passage interconnecting the first opening and the second opening, and a throttle formed by a clearance between the first opening and the inner surface of the bearing.

9 Claims, 5 Drawing Sheets

MOTOR-DRIVEN SCROLL TYPE COMPRESSOR

BACKGROUND OF THE INVENTION

The present invention relates to a motor-driven scroll type compressor.

A motor-driven scroll type compressor having a motor for driving a rotary shaft of the compressor and a scroll type compression unit for compressing refrigerant gas is generally known. In this motor-driven scroll type compressor, the motor serves as a drive source and the scroll type compression unit serves as a scroll type compressor. The motor-driven scroll type compressor has bearings provided on opposite ends of the rotary shaft with the motor located therebetween for reducing the load on the rotary shaft.

It is also known that the performance of the refrigeration system can be improved by separating lubricating oil e.g. by an oil separator from the compressed high-temperature and high-pressure refrigerant gas flowing out from the compression unit to an external refrigerant circuit for reduction of the oil rate.

However, the reduction of the oil rate of the refrigerant gas flowing out to the external refrigerant circuit decreases the supply of lubricating oil to the bearing that is located far from the compression unit thereby to deteriorate the durability of the bearing. Japanese Patent Application Publication 2007-321588 discloses a motor-driven scroll type compressor having an oil separation chamber formed in a housing of the compressor for separating lubricating oil from the refrigerant gas and an oil reserve chamber formed in sealed space in the low-pressure region of the compressor for immersing the bearing.

In the motor-driven scroll type compressor disclosed in the above Publication, lubricating oil contained in the refrigerant gas discharged into a discharge chamber is separated therefrom in the oil separation chamber and the separated lubricating oil is temporarily reserved in an oil reserve chamber located in high pressure region of the compressor. The lubricating oil thus reserved temporarily in the oil reserve chamber flows into a bottom space of a boss portion through oil supply passages formed in the fixed and movable scroll members. Thereafter, the lubricating oil flows into an oil passage formed in the rotary shaft and is reserved in an oil reserve chamber in low pressure region of the compressor. The bearing for the rotary shaft is constantly soaked in the lubricating oil reserved in the oil reserve chamber in the low pressure region.

However, the motor-driven scroll type compressor in the above Publication has no back pressure chamber behind the movable scroll member. If the invention of this Publication having no throttle in the oil supply passage is applied to a motor-driven scroll type compressor having the back pressure chamber, the pressure in the back pressure chamber leaks excessively through the oil supply passage due to the absence of the throttle in the oil supply passage, with the result that the back pressure chamber fails to function to urge the movable scroll member toward the fixed scroll member. This will result in failure of the compression unit in compressing refrigerant gas.

While it may be conceivable to provide a throttle in the oil supply passage so as to make effective the function of the back pressure chamber, it is actually difficult to form a throttle in the oil supply passage in the rotary shaft.

The present invention is made to solve the above problems of the prior art and to provide a motor-driven scroll type compressor which can stably supply the lubricating oil from the oil reserve chamber to the remote bearing as viewed from the back pressure chamber without affecting the function of the back pressure chamber.

SUMMARY OF THE INVENTION

A motor-driven scroll type compressor has a motor that includes a rotary shaft and rotates the rotary shaft, a bearing for rotatably supporting front end of the rotary shaft, a fixed scroll member, a movable scroll member driven by rear end of the rotary shaft, compression chambers defined by the movable scroll member and the fixed scroll member and a housing. The rotation of the rotary shaft makes an orbital motion of the movable scroll member around the axis of the rotary shaft and accordingly the compression chambers are moved radially and inwardly thereby to compress the refrigerant gas. The compressor further has a suction chamber communicating with the compression chambers, a discharge chamber, an oil separation chamber separating lubricating oil from the refrigerant gas and communicating with the discharge chamber and a back pressure chamber provided in front of the movable scroll member in the housing and facing to the rear end of the rotary shaft. The back pressure chamber communicates with the oil separation chamber. The rotary shaft includes a first opening at a position adjacent to the front end of the rotary shaft and facing an inner surface of the bearing, a second opening at a position adjacent to the rear end of the rotary shaft and communicating with the back pressure chamber, a communication passage interconnecting the first opening and the second opening and a throttle formed by a clearance between the first opening and the inner surface of the bearing.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

First and second embodiments according to the present invention will now be described with reference to FIGS. 1 through 5.

In the following description, the references to directions such as front and rear are indicated by double-headed arrow in FIG. 1.

First Embodiment

Figure 1:
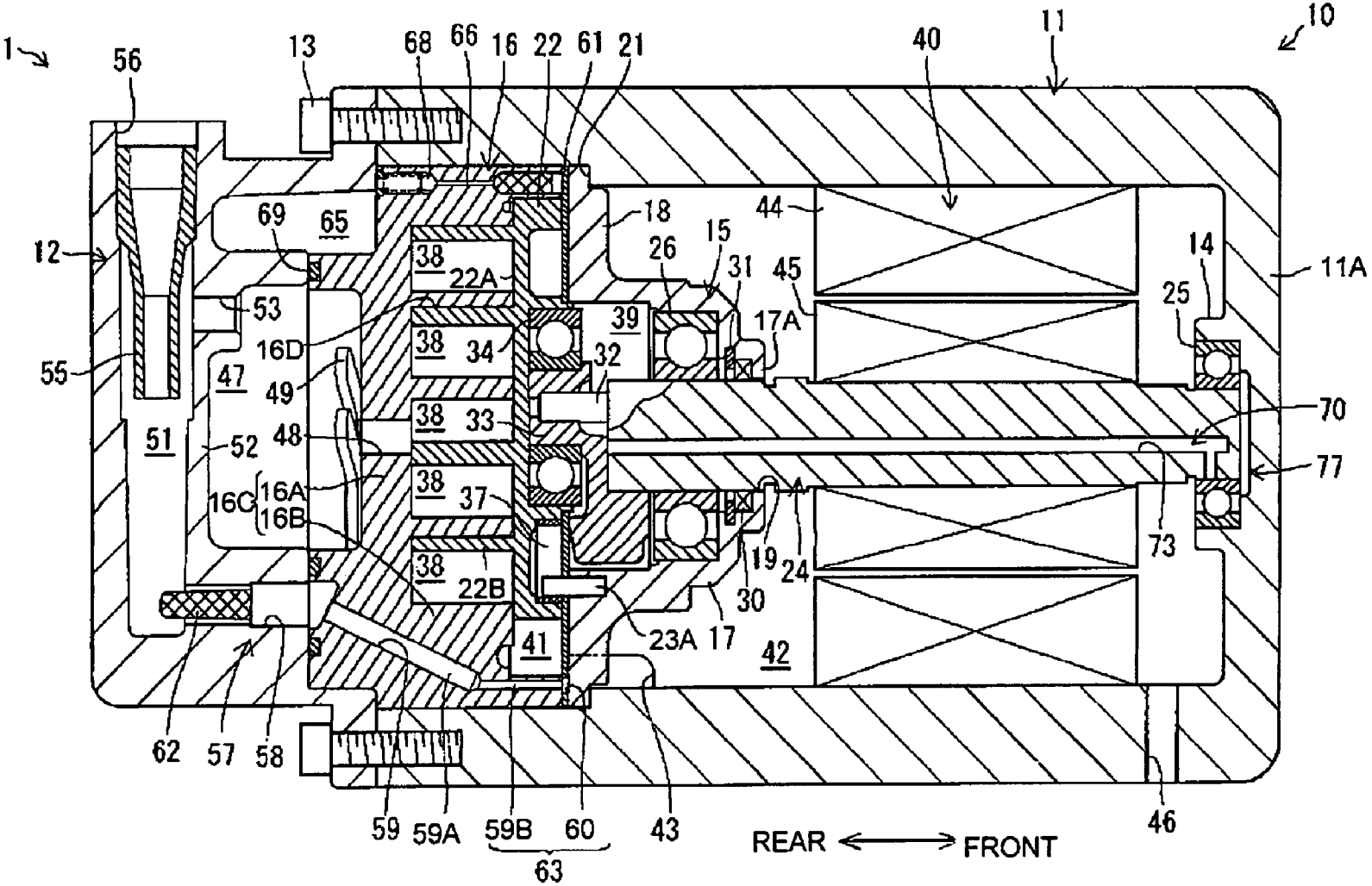
FIG. 1 is a longitudinal cross-sectional view of a motor-driven scroll type compressor according to a first embodiment of the present invention.

A motor-driven scroll type compressor 1 of the first embodiment has a housing 10, as shown in FIG. 1. The housing 10 includes a cylindrical front housing 11 with a bottom, a cover-like rear housing 12 and a shaft support member 15. The shaft support member 15 is provided in the front housing 11 and a fixed scroll member 16 is provided behind the shaft support member 15. The rear end of the front housing 11 and the front end of the rear housing 12 are jointed and fastened together by bolts 13 and the front housing 11 and the rear housing 12 cooperate to accommodate therein the fixed scroll member 16 and the shaft support member 15 in contact with each other.

The front housing 11 has a cylindrical boss 14 protruding from the center of bottom wall 11A of the front housing 11. The shaft support member 15 has a cylindrical portion 17 and a flange portion 18 extending outward from the rear end of the cylindrical portion 17. The bottom wall 17A of the cylindrical portion 17 has formed therethrough at the center thereof a shaft hole 19. The flange portion 18 is set in contact with a step 21 formed in the inner surface of the front housing 11 thereby to be restricted against moving frontward. The shaft support member 15 has a rotation prevention pin 23A fixed on the rear end thereof for preventing a movable scroll member 22 from being rotated on its own axis.

Figure 4:
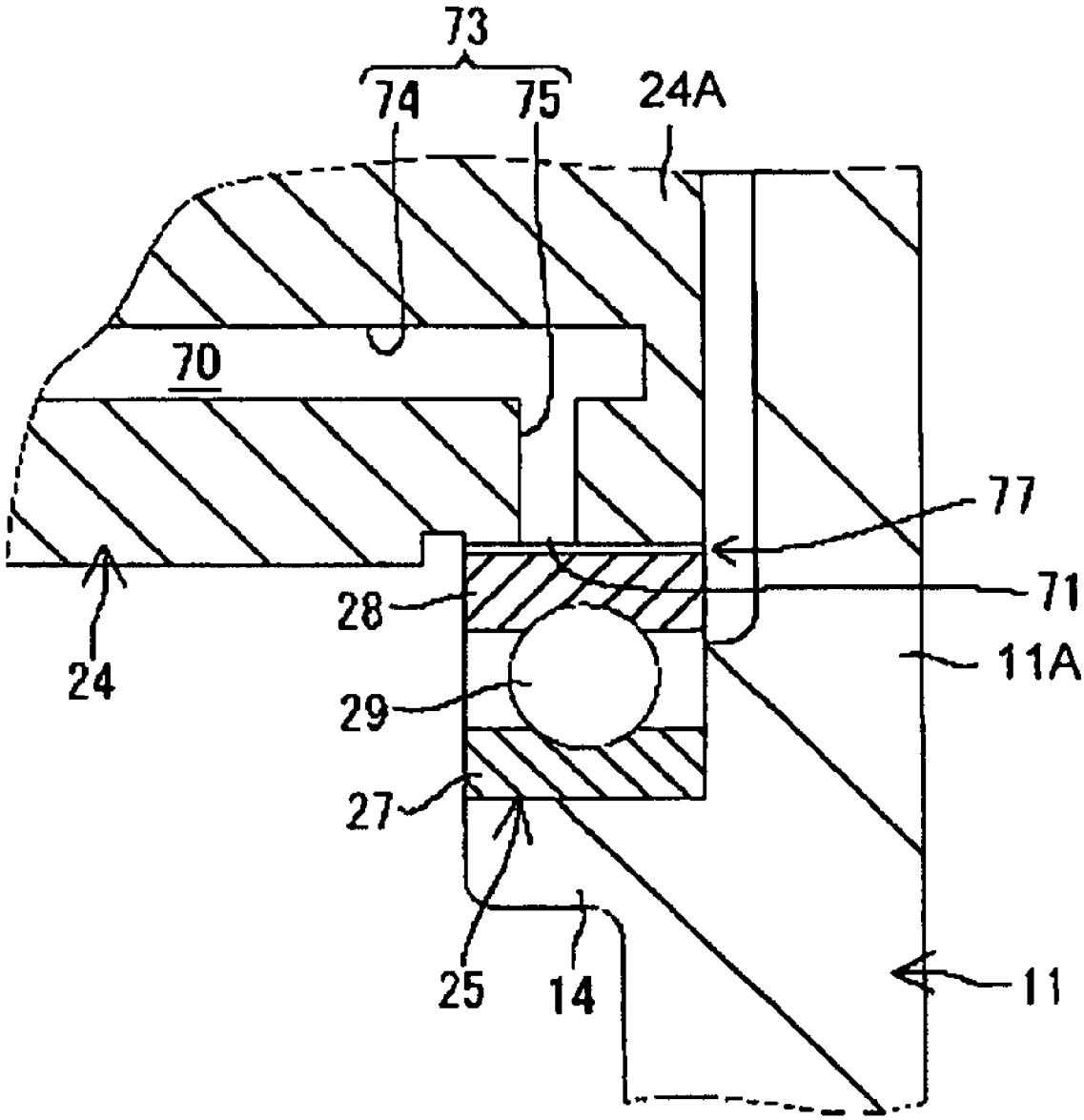
FIG. 4 is a partially enlarged cross-sectional view of the front end of the rotary shaft and front bearing of the compressor of FIG. 1.

The shaft support member 15 and the boss 14 rotatably support the rotary shaft at the opposite ends thereof through front and rear radial bearings 25 and 26. The front bearing 25 has an outer ring 27, an inner ring 28 and a plurality of rollers arranged between the rings 27 and 28, as shown in FIG. 4. The bearing 25 is fitted in the boss 14, rotatably supporting the front end 24A of the rotary shaft 24. On the other hand, the rear bearing 26 is fitted in the shaft support member 15 and the rotary shaft 24 inserted through the shaft hole 19 is fitted in the inner ring of the bearing 26, as shown in FIG. 1. Thus, the bearing 26 rotatably supports the rear end 24B of the rotary shaft 24. A seal member 30 is interposed between the shaft support member 15 and the rotary shaft 24 and held by a circlip 31 for sealing the rotary shaft 24.

Figure 2:
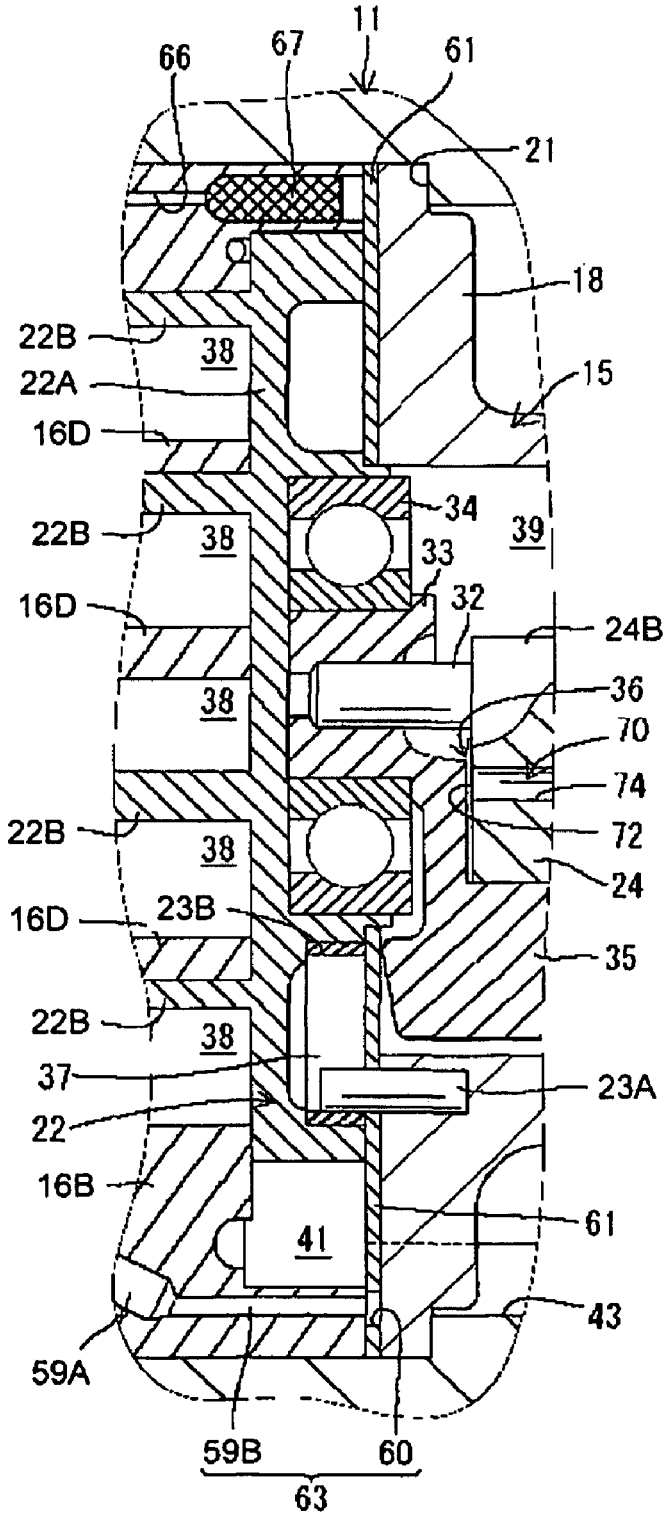
FIG. 2 is a partially enlarged cross-sectional view of a motor-driven scroll type compressor of FIG. 1.
Figure 3:
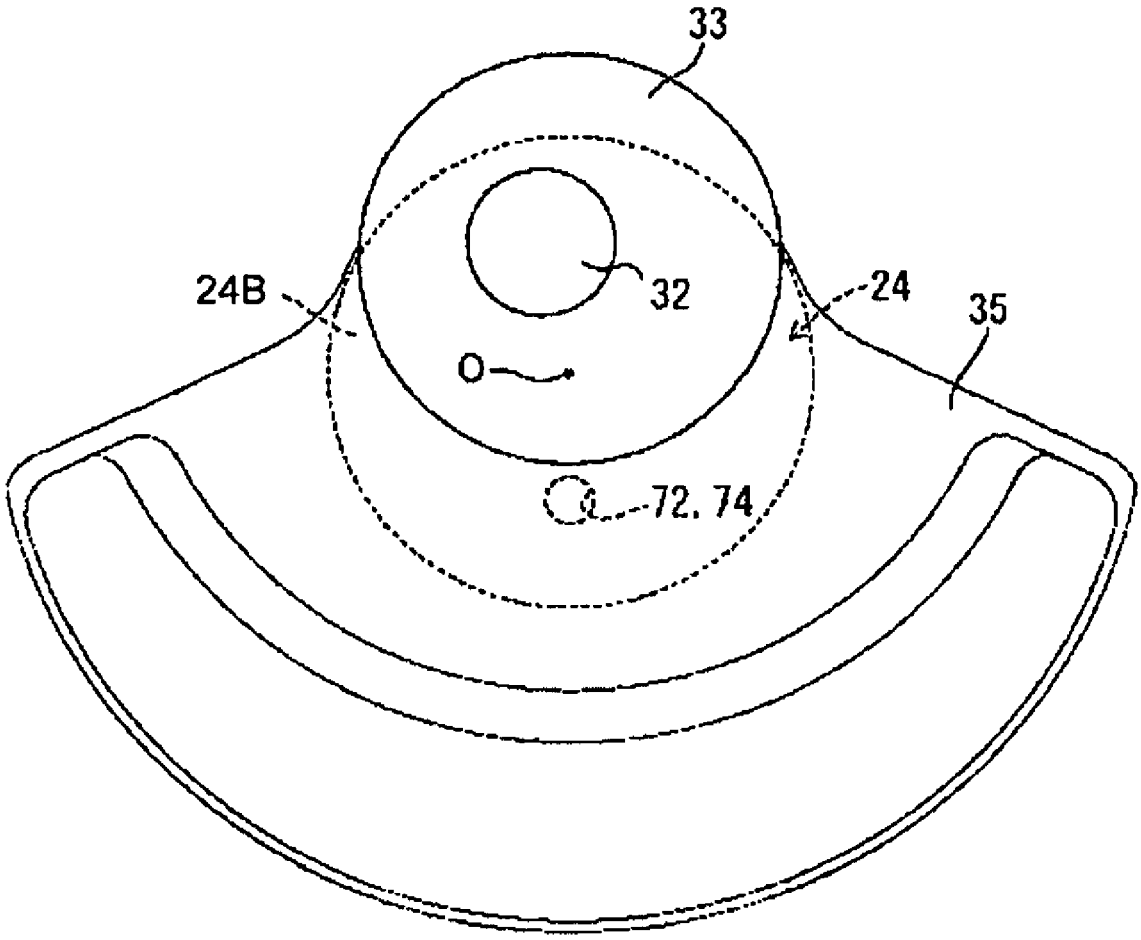
FIG. 3 is a partially enlarged cross-sectional view of the rear end of a rotary shaft and a counterbalance of the compressor of FIG. 1.

As shown in FIGS. 2 and 3, the rotary shaft 24 has an eccentric pin 32 extending from a position of the rear end of the rotary shaft 24 that is offset from the center axis O of the rotary shaft 24. The eccentric pin 32 is fitted in a cylindrical bush 33 to be supported thereby, as shown in FIG. 2. The fan-shaped counterbalance 35 is integrally formed with the bush 33 so as to cover approximately half the circumference of the bush 33, as shown in FIG. 3. The counterbalance 35 has a portion with L-shape in cross section, extending along part of the rear end and the outer periphery of the rotary shaft 24 with a clearance 36 formed therebetween, as shown in FIG. 2. The counterbalance 35 functions to cancel the centrifugal force developed by the orbital motion of the movable scroll member 22.

As shown in FIG. 1, the fixed scroll member 16 has a fixed base wall 16C composed of a base wall 16A as the bottom and a cylindrical peripheral wall 16B, and a fixed scroll wall 16D formed inside the peripheral wall 16B and extending frontward from the base wall 16A.

On the other hand, the movable scroll member 22 is provided between the bush 33 and the fixed scroll member 16 and supported by a radial bearing 34. The movable scroll member 22 has a disk-shaped movable base wall 22A and a movable scroll wall 22B extending rearward from the movable base wall 22A.

The fixed scroll member 16 and the movable scroll member 22 are engaged with each other through the fixed scroll wall 16D and the movable scroll wall 22B. The distal ends of the fixed scroll wall 16D and the movable scroll wall 22B are slidable on the movable base wall 22A and the fixed base wall 16C, respectively. As shown in FIG. 2, the movable base wall 22A has formed in the front surface thereof a recess as a hole 37 and a ring 23B is fitted in the hole 37. One end portion of the rotation prevention pin 23A is loosely fitted in the hole 37 through the ring 23B so that the rotation prevention pin 23A is rollable in sliding contact with the inner surface of a ring 23B.

Compression chambers 38 are formed between the fixed base wall 16C with the fixed scroll wall 16D of the fixed scroll member 16 and the movable base wall 22A with the movable scroll wall 22B of the movable scroll member 22. A back pressure chamber 39 faces to the rear end 24B of the rotary shaft 24 between the front side of the movable base wall 22A (or the opposite side of the movable base wall 22A from the compression chamber 38) and the shaft support member 15. Furthermore, the shaft support member 15, the peripheral wall 16B and the outermost peripheral portion of the movable scroll wall, 22B cooperate to define therebetween a suction chamber 41.

As shown in FIG. 1, the front housing 11 has formed therein a suction region 42 in the front of the shaft support member 15. The suction region 42 communicates with the suction chamber 41 through a suction passage 43 formed in lower portion of the front housing 11. In the suction region 42, a stator 44 is fixed on the inner peripheral surface of the front housing 11 and a rotor 45 is located inward of the stator 44 and fixed on the rotary shaft 24. The rotor 45, the stator 44 and the rotary shaft 24 cooperatively form a motor 40 and the rotor 45 is rotated integrally with the rotary shaft 24 when electric current is supplied to the stator 44 (when the stator 40 is energized).

The front housing 11 has formed therethrough at a position adjacent to the front end thereof an inlet 46 through which the suction region 42 communicate with an evaporator (not shown) via a conduit. The evaporator communicates with an expansion valve and a condenser via a conduit. The motor-driven scroll type compressor 1, the evaporator, the expansion valve and the condenser cooperate to form a refrigerant circuit for a vehicle air conditioner. Low-pressure and low-temperature refrigerant gas in the refrigerant circuit is supplied into the suction chamber 41 through the inlet 46, the suction region 42 and the suction passage 43.

A discharge chamber 47 is formed between the rear surface of the fixed base wall 16C and the front surface of the rear housing 12. The fixed base wall 16C has formed therethrough at the center thereof a discharge port 48 through which the compression chamber 38 is communicable with the discharge chamber 47. The fixed base wall 16C has on the rear surface thereof a discharge valve (not shown) for opening and closing the discharge port 48 and a retainer 49 for regulating the opening degree of the discharge valve.

The rear housing 12 has formed therein behind the discharge chamber 47 an oil separation chamber 51 extending vertically with the compressor mounted on the vehicle and also a partition wall 52 between the oil separation chamber 51 and the discharge chamber 47. The partition wall 52 has formed therethrough a discharge port 53 interconnecting the oil separation chamber 51 and the discharge chamber 47. An oil separator 55 is provided in the oil separation chamber 51 so as to separate the lubricating oil from the refrigerant gas. The oil separator 55 has a cylindrical shape and is fitted in the oil separation chamber 51. The lubricating oil is separated by the action of the centrifugal force from the refrigerant gas flowing from the discharge chamber 47 into the oil separation chamber 51 through the discharge port 53. The separated lubricating oil falls to be reserved in the oil separation chamber 51. The upper end of the oil separation chamber 51 located above the oil separator 55 forms an outlet 56 through which the oil separating chamber 51 communicates with the condenser of the refrigerant circuit via a conduit.

The oil separation chamber 51 communicates with the back pressure chamber 39 through an oil passage 57 so that the lubricating oil under a discharge pressure is supplied to the back pressure chamber 39 through the oil passage 57. The oil passage 57 includes a connection passage 58, a communication passage 59 and a slit 60. The connection passage 58 is formed through the rear housing 12, extending longitudinally of the compressor and opened to the bottom of the oil separation chamber 51 and the front end of the rear housing. The communication passage 59 is formed through the peripheral wall 16B of the scroll member 16. The slit 60 is formed through a disk-shaped plate 61 which is interposed between the shaft support member 15 and the movable scroll member 22, extending to the back pressure chamber 39, as shown in FIG. 2. The connection passage 58, the communication passage 59 and the slit 60 are arranged in this order as viewed in the flowing direction of the lubricating oil.

As shown in FIG. 1, an oil filter 62 is fixedly mounted in the connection passage 58 for removing foreign matters from lubricating oil and the rear end thereof protrudes into the oil separation chamber 51. The communication passage 59 includes an inclined passage 59A formed adjacent to the connection passage 58 and extending frontward with a falling gradient and a horizontal passage 59B formed adjacent to the slit 60 and extending longitudinally of the compressor 1. The diameter of the horizontal passage 59B is smaller than that of the inclined passage 59A and the cross sectional area of the slit 60 is substantially the same as that of the horizontal passage 59B. The horizontal passage 59B and the slit 60 cooperatively form a second throttle 63 in the oil passage 57. The slit 60 is disposed so as to get around the region of the suction chamber 41.

The rear housing 12 and the fixed base wall 16C cooperate to define an oil reserve chamber 65 located in radially outer region of the discharge chamber 47 and also in front of the oil separation chamber 51. The oil reserve chamber 65 communicates with the back pressure chamber 39 through an oil bleed passage 66 so that excess lubricating oil in the back pressure chamber 39 returns to the oil reserve chamber 65. The oil bleed passage 66 is formed through the peripheral wall 16B of the fixed scroll member 16, extending longitudinally of the compressor 1. An oil filter 67 is fixedly mounted in the front of the oil bleed passage 66, as shown in FIG. 2, and a check valve 68 is provided in the rear of the oil bleed passage 66, as shown in FIG. 1, so as to allow the lubricating oil to flow only toward the oil reserve chamber 65. The oil filter 67 and the check valve 68 regulate the pressure in the back pressure chamber 39. A seal ring 69 is interposed between the fixed base wall 16C and the rear housing 12 for sealing between the discharge chamber 47 and the oil passage 57 and also between the discharge chamber 47 and the oil reserve chamber 65. Thus, the seal ring 69 prevents refrigerant gas in the discharge chamber 47 from leaking to the oil passage 57 and the oil reserve chamber 65. The oil reserve chamber 65 also communicates with the suction chamber 41 through a passage not shown.

The rotary shaft 24 has formed therethrough an oil supply passage 70 through which the lubricating oil in the back pressure chamber 39 is supplied to the bearing 25 in the suction-pressure region under a lower pressure as compared to that of the back pressure chamber 39. The oil supply passage 70 has a first opening 71 at a position adjacent to the front end 24A of the rotary shaft 24 and facing the inner ring 28 of the front bearing 25 (refer to FIG. 4), a second opening 72 (refer to FIG. 2) at a position adjacent to the rear end of the rotary shaft 24 and facing the back pressure chamber 39 and an axial communication passage 73 interconnecting the first opening 71 and the second opening 72. More specifically, as shown in FIG. 4, the communication passage 73 has a main supply passage 74 extending in the axial direction of the rotary shaft 24 from the dead end adjacent to the front end to the second opening 72 at the rear end and a subsidiary oil supply passage 75 extending radially from one end in communication with the front end portion of the main supply passage 74 to the first opening 71. The inner diameter of the main oil supply passage 74 and the subsidiary oil supply passage 75 is substantially the same over the entire lengths thereof so that that the oil supply passage 70 has no throttle.

As shown in FIG. 3, the main oil supply passage 74 extends along an axis that is offset from the axis O of the rotary shaft 24 toward the counterbalance 35. As shown in FIGS. 2 and 3, the second opening 72 of the oil supply passage 70 at the rear end of the rotary shaft 24 is located around the outer region of the bush 33 of the counterbalance 35 in facing relation to the counterbalance 35 while maintaining a clearance 36 between the rear end of the rotary shaft 24 and the front surface of the bush 33. As shown in FIG. 4, a clearance is formed between the inner ring 28 of the front bearing 25 and its opposed first opening 71 (located at the outer surface of the rotary shaft 24) and set so as to function as a first throttle 77 with such an opening degree that secures a required pressure in the back pressure chamber 39 and a supply of an appropriate amount of lubricating oil to the bearing 25. Primarily, the pressure for supplying the lubricating oil to the oil supply passage 70 is restricted by the clearance 36 and, secondarily, that pressure is further restricted by the first throttle 77. The oil supply passage 70 is opened to the outer surface of the rotary shaft 24 only at the first and the second openings 71, 72.

The following will describe the operation of the above-described motor-driven scroll type compressor. When the rotary shaft 24 of the motor 40 is driven to rotate by the operation of a vehicle operator, the eccentric pin 32 turns around the axis of the fixed scroll member 16. In this case, the rotation prevention pin 23A is in sliding and rolling contact with the inner surface of the ring 23B and, accordingly, the rotation of the movable scroll member 22 on its own axis is prevented and the movable scroll member 22 makes an orbital motion around the axis of the rotary shaft 24. Thus, the compression chambers 38 are moved radially inwardly from the outer peripheral side of the fixed and movable scroll members 16, 22 toward their center by the orbital motion of the movable scroll member 22, thereby progressively reducing volume thereof. Therefore, the refrigerant gas introduced into the suction chamber 41 and then the compression chamber 38 from the evaporator through the inlet 46, the suction region 42 and the suction passage 43 is compressed in the compression chamber 38. The refrigerant gas compressed to a discharge-pressure is discharged through the discharge port 48 into the discharge chamber 47 and then flows into the oil separation chamber 51 through the discharge port 53. After the lubricating oil is separated from refrigerant gas in the oil separation chamber 51, the refrigerant gas is discharged from the oil separator 55 to the condenser. Thus, the air conditioning for the vehicle is performed.

The lubricating oil separated from the refrigerant gas falls from the oil separator 55 to be reserved in the oil separation chamber 51. The lubricating oil reserved in the oil separation chamber 51 is supplied to the back pressure chamber 39 through the oil passage 57 together with a small amount of refrigerant gas. While the lubricating oil passes through the oil passage 57, foreign matters contained in the oil are removed therefrom by the oil filter 62, so that foreign matters are prevented from being accumulated in the second throttle 63 located downstream of the oil filter 62. The pressure in the back pressure chamber 39 is restricted to a determined pressure by the second throttle 63 in the oil passage 57. The lubricating oil supplied to the back pressure chamber 39 serves to lubricate the rear bearing 26, the bearing 34, the eccentric pin 32 and the bush 33 as a part of the drive for the movable scroll member 22. The pressure in the back pressure chamber 39 functions to oppose the pressure in the compression chambers 38 so as to urge the movable scroll member 22 toward the fixed scroll member 16 thereby to reduce sliding resistance between the movable base wall 22A and the shaft support member 15 and also to secure the airtightness of the compression chambers 38.

The lubricating oil supplied to the back pressure chamber 39 is introduced into the oil supply passage 70 through the clearance 36 and the second opening 72 and drawn to the suction region 42 that is placed under a lower pressure as compared to the back pressure chamber 39. Accordingly, the lubricating oil is delivered from the communication passage 73 to the first throttle 77 through the first opening 71 thereby to properly lubricate the inner ring 28 of the front bearing 25 in accordance with the rotation of the rotary shaft 24.

Since the motor 40 is disposed in the suction region 42 of the compressor 1 which is in communication with the refrigeration circuit through the inlet 46, the motor 40 is cooled properly by low-temperature refrigerant gas returning from the evaporator while the motor-driven scroll type compressor 1 is in operation, so that the compressor 1 maintains good durability.

In the motor-driven scroll type compressor 1 of the above embodiment, the amount of the lubricating oil supplied from the oil separation chamber 51 to the bearing 25 through the back pressure chamber 39 and the oil supply passage 70 in the rotary shaft 24 is regulated by the first throttle 77. Accordingly, an appropriate amount of lubricating oil is kept in the back pressure chamber 39 under an appropriate pressure. Therefore, the lubrication of the drive part for the movable scroll member 22 is maintained and the movable scroll member 22 is properly urged toward the fixed scroll member 16, with the result that appropriate airtightness of the compression chambers 38 is maintained.

In the motor-driven scroll type compressor 1 of the above embodiment wherein the first throttle 77 is accomplished by properly adjusting the clearance between the first opening 71 of the oil supply passage 70 and the inner surface 28C of the inner ring 28 of the bearing 25, the structure of the compressor is simple as compared to a case where a throttle is formed in the rotary shaft of the compressor. Especially, since the lubricating oil flowed from the oil separation chamber 51 through the oil filter 62 is supplied to the oil supply passage 70, the oil supply passage 70 may dispense with an oil filter and, therefore, the compressor is simplified in structure.

The motor-driven scroll type compressor 1 with a simplified structure is easy to manufacture, thereby reducing the production cost. Further, the function of the back pressure chamber 39 of the motor-driven scroll type compressor 1 is affected in no way, the compressor 1 can operate with a high efficiency. Furthermore, in this motor-driven scroll type compressor 1, a sufficient amount of lubricating oil is supplied from the oil separation chamber 51 to the bearing 25 located far from the back pressure chamber 39 and, therefore, the compressor 1 offers a good durability.

The second throttle 63 in the oil passage 57 and the first throttle 77 in the oil supply passage 70 cooperatively function to maintain a certain amount of lubricating oil and also certain level of pressure in the back pressure chamber 39. Therefore, proper lubrication for the drive mechanism of the movable scroll member 22 is maintained and the movable scroll member 22 is properly urged toward the fixed scroll member 16, with the result that the airtightness of the compression chambers 38 is maintained effectively. Since the first throttle 77 in the oil supply passage 70 operates downstream of the second throttle 63 in the oil passage 57, the discharge pressure will not be decreased unnecessarily. In the motor-driven scroll type compressor 1, the counterbalance 35 formed integrally with the bush 33 hardly moves in the axial direction of the rotary shaft 24, so that the clearance 36 between the second opening 72 and the counterbalance 35 hardly changes. Since the lubricating oil flows from the second opening 72 into the oil supply passage 70 through the clearance 36, the pressure of the lubricating oil is also restricted by the clearance 36.

Second Embodiment

Figure 5:
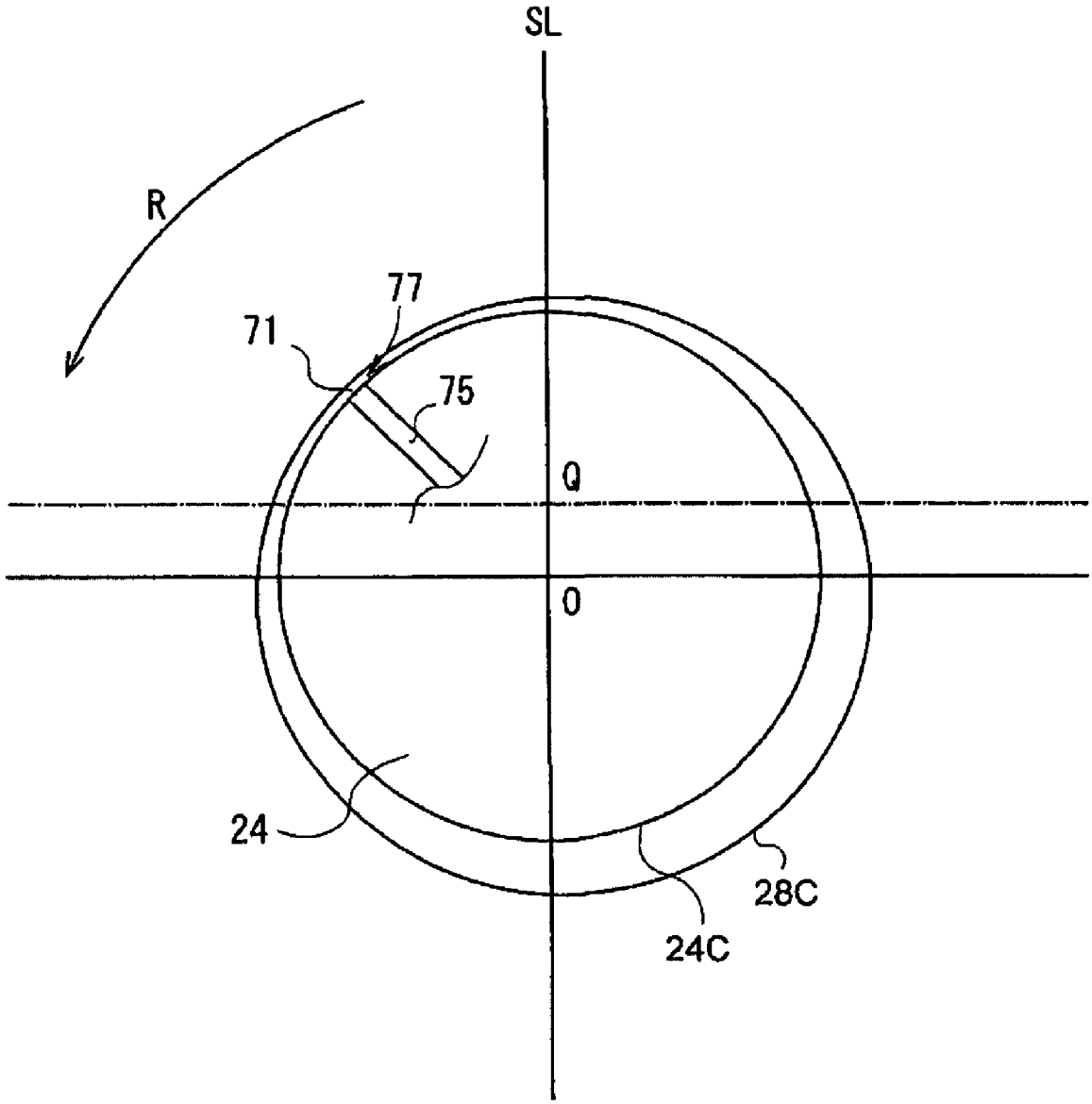
FIG. 5 is a schematic view of a motor-driven scroll type compressor according to a second embodiment of the present invention, showing the rotary shaft of the compressor and the coordinates perpendicular to the axis of the rotary shaft.

In the motor-driven scroll type compressor 1 according to the second embodiment shown in FIG. 5, the first opening 71 is opened somewhere in the range between 0° and 90° in the orbital direction R of the movable scroll member 22 from an imaginary reference line SL that extends from the zero point 0 corresponding to the central axis O of the rotary shaft 24 and passes through the central axis Q of the eccentric pin 32. The rest of the structure of the compressor is substantially the same as that of the first embodiment.

According to the inventors, the outer peripheral surface 24C at the front end portion 24A of the rotary shaft 24 approaches closest to the inner surface 28C of the inner ring 28 of the bearing 24 in the above range.

At what degree with respect to the line "SL" the outer peripheral surface 24C approaches most close to the inner surface 28C varies depending on the compression reactive force and other factors. Therefore, forming the first opening 71 within this range, the opening degree of the first throttle 77 becomes smallest, with the result high compression efficiency can be achieved.

The present invention is not limited to the above embodiments 1 and 2. For example, the oil supply passage 70 may extend along the central axis O of the rotary shaft. The oil bleed passage 66 may dispense with the oil filter 67 and the check valve 68.

The present invention can be applied to an air conditioning system for a vehicle.

What is claimed is:

1. A motor-driven scroll type compressor comprising:

a motor, wherein the motor has a rotary shaft and rotates the rotary shaft;

a bearing for rotatably supporting front end of the rotary shaft;

a fixed scroll member;

a movable scroll member driven by rear end of the rotary shaft;

a housing having therein the motor, the bearing, the fixed scroll member and the movable scroll member;

compression chambers defined by the movable scroll member and the fixed scroll member cooperatively, wherein the rotation of the rotary shaft makes an orbital motion of the movable scroll member around the axis of the rotary shaft and accordingly the compression chambers are moved radially and inwardly thereby to compress the refrigerant gas;

a suction chamber defined by the housing, the fixed scroll member and the movable scroll member, the suction chamber communicating with the compression chambers;

a discharge chamber provided in the housing;

an oil separation chamber provided in the housing and separating lubricating oil from the refrigerant gas and communicating with the discharge chamber; and a back pressure chamber provided in front of the movable scroll member in the housing, and facing to the rear end of the rotary shaft, wherein the back pressure chamber communicates with the oil separation chamber, wherein the rotary shaft includes:

a first opening at a position adjacent to the front end of the rotary shaft and facing an inner surface of the bearing;

a second opening at a position adjacent to the rear end of the rotary shaft and communicating with the back pressure chamber;

a communication passage interconnecting the first opening and the second opening, wherein the first opening, the second opening and the communication passage cooperate to form an oil supply passage; and a throttle formed by a clearance between the first opening and the inner surface of the bearing.

2. The scroll type motor compressor according to claim 1, further comprising:

an oil passage interconnecting the oil separation chamber and the back pressure chamber; and a second throttle provided in the oil passage.

3. The scroll type motor compressor according to claim 1, further comprising:

an oil filter provided in the oil passage.

4. The scroll type motor compressor according to claim 2, further comprising;

a shaft support member, wherein the fixed scroll member is provided behind the shaft support member in the housing, and a plate interposed between the shaft support member and the movable scroll member, wherein a slit is formed through the plate, the slit communicating with the back pressure chamber and serving as the second throttle.

5. The scroll type motor compressor according to claim 1, further comprising:

an eccentric pin, wherein the eccentric pin is extending from a position of the rear end of the rotary shaft that is offset from the center axis of the rotary shaft;

a bush, wherein the bush is interposed between the eccentric pin and the movable scroll member, the eccentric pin being fitted in the bush to be supported, and a counterbalance, wherein the counterbalance is integrally formed with the bush in facing relation to the second opening with a clearance formed therebetween and cancels the centrifugal force developed by the orbital motion of the movable scroll member.

6. The scroll type motor compressor according to claim 1, wherein the first opening is formed on outer peripheral surface of the rotary shaft where inner surface of the bearing is closest to the first opening.

7. The scroll type motor compressor according to claim 1, wherein the first opening is opened at a position in the circumferential range between 0° and 90° in the orbital direction of the movable scroll member from an imaginary reference line that extends radially from a point corresponding to a central axis of the rotary shaft and passes through a point corresponding to a central axis of the eccentric pin.

8. The scroll type motor compressor according to claim 1, further comprising:

an oil reserve chamber located in radially outer region of the discharge chamber and also in front of the oil separation chamber;

an oil bleed passage interconnecting the oil reserve chamber and the back pressure chamber;

a check valve provided in the oil bleed passage so as to allow lubricating oil to flow only toward the oil reserve chamber, and an oil filter provided in the oil bleed passage.

9. The scroll type motor compressor according to claim 1, the communication passage having:

a main oil supply passage extending in an axial direction of the rotary shaft from dead end adjacent to the front end to the second opening at the rear end, and a subsidiary oil supply passage extending radially so as to interconnect the main oil supply passage and the first opening.

* * * * *